United States Patent [19]

Kita

[11] Patent Number: 4,715,266

[45] Date of Patent: Dec. 29, 1987

[54] ROTARY FLUID ENERGY CONVERTER

[75] Inventor: Yasuo Kita, Kyoto, Japan

[73] Assignee: Shimadzu Corporation, Kyoto, Japan

[21] Appl. No.: 921,079

[22] Filed: Oct. 21, 1986

[51] Int. Cl.[4] ..... F01B 13/04; F01B 13/06

[52] U.S. Cl. ..... 91/488; 91/497

[58] Field of Search ..... 91/488, 491, 497

[56] References Cited

U.S. PATENT DOCUMENTS

| | | | |
|---|---|---|---|
| 1,563,282 | 11/1925 | Jessup . | |
| 2,862,456 | 12/1958 | Bauer | 91/488 |
| 3,650,180 | 3/1972 | Gantschnigg | 91/488 |
| 4,137,826 | 2/1979 | Rita | 91/497 |

FOREIGN PATENT DOCUMENTS

| | | | |
|---|---|---|---|
| 78513 | 5/1983 | European Pat. Off. | 91/472 |

*Primary Examiner*—William L. Freeh

*Attorney, Agent, or Firm*—Armstrong, Nikaido, Marmelstein & Kubovcik

[57] ABSTRACT

A rotary fluid energy converter which is used either as a hydraulic pump or as a fluid motor has a housing, a torque ring, pistons, a cylinder barrel, and spaces. The ring is closely held against the inner surface of the housing via first static pressure bearing which are circumferentially spaced from one another. As the ring is rotated relative to the housing, the volumes of the spaces increase or decrease. Each of the first bearings has two pressure pockets axially adjacent each other. Fluid flows out of the spaces and is distributed to the corresponding pressure pockets via restrictors.

2 Claims, 25 Drawing Figures

ROTARY FLUID ENERGY CONVERTER

FIELD OF THE INVENTION

The present invention relates to a rotary fluid energy converter that is used either as a hydraulic pump or as a hydraulic motor of hydrostatic type.

BACKGROUND OF THE INVENTION

A conventional rotary energy converter of this kind is employed as a hydrostatic hydraulic pump or motor and always uses mechanisms, such as cam mechanisms and linkages, for converting rotary power applied to its input shaft into rectilinear motion of a piston, plunger, or the like and for converting such rectilinear motion of the piston into rotary motion of its output shaft. Since its components are pressed against each other or a twisting force is applied to some components, the converter must employ bearings that make use of either wedging action of oil film utilizing oiliness or viscosity of lubricating oil or rolling action of balls, rollers, or the like. Therefore, an oil having an appropriate viscosity is required to be used as working fluid. If water or other fluid is approximate in viscosity to water is used as working fluid, it will be difficult to operate the converter smoothly. This makes the life of the machine quite short. Thus, working fluids that can be used are limited to certain kinds. If roller bearings are used, the life of the whole machine depends on the life of worn bearings, making it difficult to enhance the durability. Further, roller bearings are relatively bulky. This renders it difficult to make the machine smaller and lightweight.

Recently, an almost ideally efficient flud energy converter which operates on quite different principles from prior art techniques described above has been developed (see Japanese Patent Laid-Open No. 77179/1983). Specifically, this converter comprises a housing having a tapering surface in its inner surface, a torque ring which is closely held against the tapering surface of the housing via first static pressure bearings disposed circumferentially from one another and having flat surfaces corresponding to the first bearings on its inner surface, a plurality of pistons disposed on the inner side of the ring and connected on the front ends thereof to the flat surfaces of the ring via second static pressure bearings, respectively, a cylinder barrel for supporting the bottom ends of the pistons so as to be slidable therein, a pintle which is disposed in an eccentric relation from the axis of the housing and supporting the barrel, spaces formed between each piston and the barrel and which increase or decrease the volume with the relative rotation of the housing and the ring, a pair of fluid communication passages for communicating the spaces whose volumes are increasing and decreasing, respectively, and fluid passages for introducing fluid from the spaces into the first and second bearings. Consequently, the static pressures of the fluid introduced into the first and second bearings develop several forces about the axis of rotation of the torque ring.

In each first static pressure bearing having a single pressure pocket, the center of pressure of each bearing is maintained at a certain position and so other forces, that are produced about a position not lying on the axis of rotation, acts on the ring. This structure is now described by referring to FIGS. 11 and 12, where the static pressure in each first static pressure bearing a produces a force $F_a$ that acts along a line of action $L_a$.

This line $L_a$ passes across the center of pressure (geometrical center) b of the bearing a, and every line of action $L_a$ center on a point d on the axis m of both the housing c and the torque ring k. The static pressure in each second static pressure bearing e produces a force $F_b$ that acts along a line of action $L_b$. Every such line of action $L_b$, that is, the center lines g of the pistons f center on a point i on the axis n of the pintle h. Therefore, where the inner surface j of the housing c has a tapering surface if the torque ring k is rotated relative to the housing c by displacing the axis n of the pintle h from the axis m of the housing c, the center g of the pintle f periodically moves away from the pressure center (geometrical center) b of the bearing a while following an elliptic orbit p as shown in FIG. 12. In this case, the movement of the center g relative to the pressure center b along the axis X is needed to produce a couple of forces about the axis of rotation of the ring k. However, displacement along axis Y bends or twists the ring k. This may impair advantageous features of this system, such as excellent durability and the ability to run smoothly and efficiently.

SUMMARY OF THE INVENTION

It is an object of the present invention to provide an energy converter equipped with a simple structure which effectively prevents a couple of forces from occurring about a point not lying in the axis of rotation, which would otherwise be produced by the axial deviation of the pressure center of each first static pressure bearing from the center of each piston.

In one embodiment of the invention, the fluid energy converter has the aforementioned special structure as its fundamental structure. The converter is characterized in that each first static pressure bearing has a pair of pressure pockets axially neighboring one another and that fluid of the corresponding spaces is distributed to each pressure pocket via restrictors.

In another embodiment of the invention, in addition to the above-mentioned structure of the first embodiment, the fluid energy converter comprises each first static pressure bearing having a plurality of pressure pockets axially neighboring one another and slide valve elements for selectively cutting off the supply of fluid into the pressure pockets by utilizing relative axial movement between each piston and the torque ring, whereby the axial gap between the center of pressure of each first bearing and the center of each piston is minimized.

In the structure constructed according to the above-mentioned first embodiment, when the center of each piston axially moves away from the geometrical center of each first bearing, each fluid leakage gap of the bearings that is more remote from each piston becomes slightly larger than each fluid leakage gap of the bearings that is closer to each piston, by the flexing of the torque ring due to hydraulic pressure. Thus, the pressure inside each pressure pocket more remote from each piston becomes lower than the pressure inside each pressure pocket closer to each piston. As a result, the center of pressure of each first bearing comes closer to each piston than the geometrical center. Thus, the axial gap between the center of pressure and the center of each piston is automatically reduced.

In the structure constructed according to the above-mentioned second embodiment, when the center of each piston axially moves away from the geometrical center of each first bearing, the switching action of each slide valve element cuts off the supply of pressure fluid into certain pressure pockets, so that the center of pressure of each first bearing moves closer to the piston than the geometrical center. As a result, the axial gap between the center of pressure and the center of each piston is automatically reduced.

Other objects and features of the invention will appear in the course of description that follows.

DETAILED DESCRIPTION OF THE INVENTION

Figure 4:
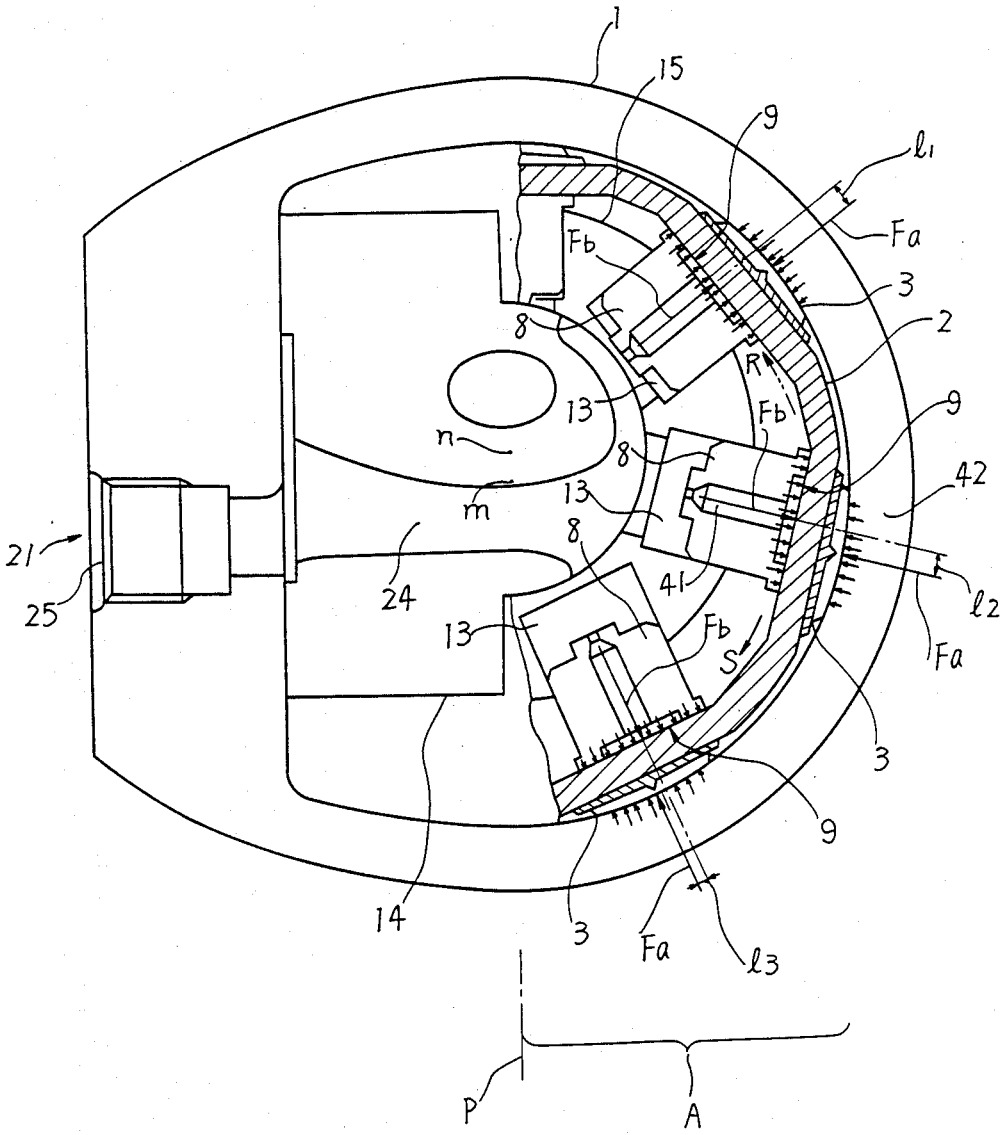
FIG. 4 is a cross-sectional view taken on line IV—IV of FIG. 3.
Figure 5:
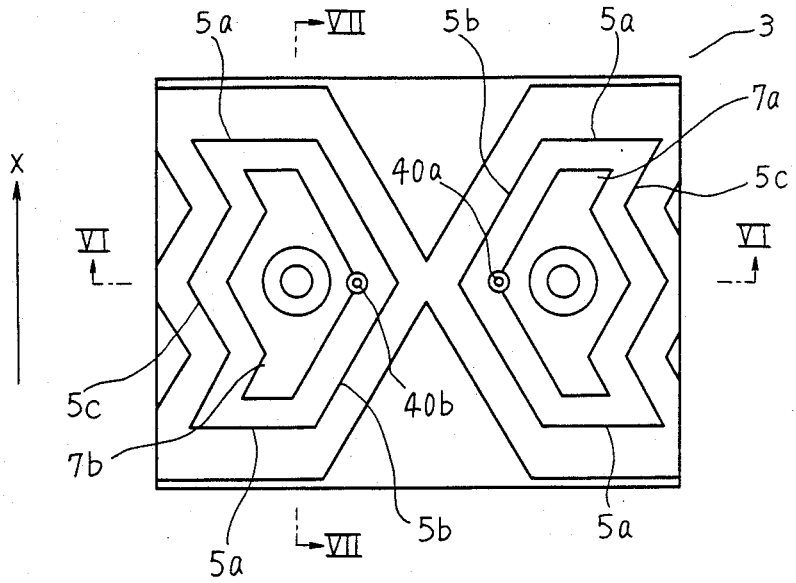
FIG. 5 is an enlarged plan view of the pressure pockets in one first static pressure bearing of the converter shown in FIG. 1.
Figure 6:
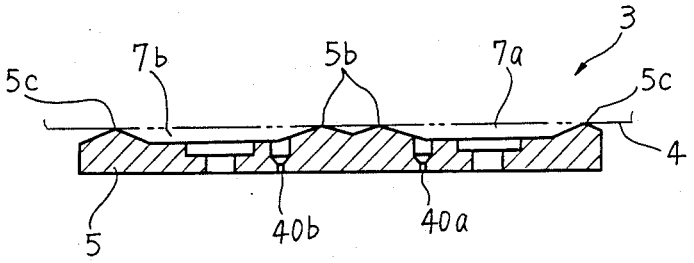
FIG. 6 is a cross-sectional view taken on line VI—VI of FIG. 5.
Figure 7:
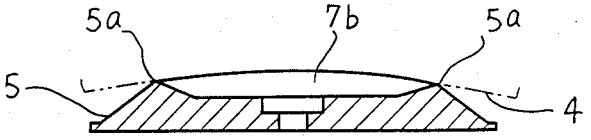
FIG. 7 is a cross-sectional view taken on line VII—VII of FIG. 5.

Referring to FIGS. 1–10, there is shown an energy converter according to the instant invention. This converter has a cylindrical housing 1 having a bottom, and a torque ring 2 is rotatably and closely mounted on the inner surface of the housing 1 by means of first static pressure bearings 3. The housing 1 is provided with an opening 1*a* at one end thereof. The inner surface of the housing has a surface 4 tapering toward the opening 1*a*, and the ring 2 is in contact with this tapering surface 4. The ring 2 is shaped like a cup and has a peripheral wall 2*a* that forms the same taper angle as the tapering surface 4. A rotating shaft 6 is formed integrally with the ring 2 and protrudes from one axial end thereof. The front end portion of the shaft 6 extends outwardly from the housing 1 through the opening 1*a*. The first bearing 3 rigidly fixes shoes 5 to the outer surface of the ring 2 at required positions, each shoe 5 being pressed on the tapering surface 4 of the housing 1. Each shoe 5 is provided with a pair of pressure pockets, 7*a* and 7*b*, axially adjacent one another. Hydraulic pressure is introduced into the pockets 7*a* and 7*b*. The odd number of bearings 3 are circumferentially and regularly spaced apart from one another. The pockets 7*a* and 7*b* of each shoe 5 are surrounded by surrounding portions 5*a*, 5*b*, 5*c* which are so shaped that their cross section protrudes toward the tapering surface 4 as shown in FIGS. 5–7. Each shoe 5 makes sliding contact with the tapering surface 4 with a small area. Also, the surrounding portions 5*a*–5*c* are so shaped that they are not parallel to axis of rotation X.

More specifically, only the surrounding portion 5*a* vertical to the axis of rotation X is straight. The surrounding portion 5*b* is shaped like the letter "V". The surrounding portion 5*c* is shaped in a zigzag manner. The inner surface of the torque ring 2 has flat surfaces 2*c* at positions corresponding to the bearings 3.

Pistons 8 are disposed at pistions corresponding to the inner flat surfaces 2*c*. The front ends 8*a* of the pistons 8 are pressed against their corresponding surfaces 2*c* via second static pressure bearings 9. The bearings 9 are made planar so that the front ends 8*a* of the pistons 8 may come into close contact with their corresponding surfaces 2*c*. Each front end 8*a* has a pressure pocket 11 into which hydraulic pressure is introduced. The base end of each piston 8 is held by a piston retainer 12. A space 13 is formed between the retainer 12 and the piston 8 to admit fluid to it.

The piston retainer 12 consists of a pintle 14 having a sliding portion 14*a* together with an annular cylinder barrel 15. The sliding portion 14*a* is supported on the housing 1. The pintle 14 can rotate about an axis n that is parallel to the axis m of both the housing 1 and the torque ring 2. The barrel 15 is rotatably fitted over the outer periphery of the pintle 14. The barrel 15 is provided with cylinders 16 which are regularly and circumferentially spaced apart from one another and are arranged radially. The axis of each cylinder 16 is substantially perpendicular to the outer surface of the pintle 14. The pistons 8 are fitted in the cylinders 16 so as to be slidable. The base surface 8*b* of each piston 8 and the inner surface of each cylinder 16 form the aforementioned space 13. The barrel 15 is connected to the torque ring 2 via an Oldham coupling 20 or similar part, so that the barrel can rotate at the same angular velocity as the ring 2.

The pintle 14 takes the form of a truncated cone whose outer surface makes a taper angle substantially equal to the taper angle formed by the peripheral wall 2*a* of the ring 2. The pistons 8 are so held that they can move back and forth perpendicularly to the peripheral wall 2*a* of the ring 2. The sliding portion 14*a* of the pintle 14 is shaped in the form of a block of longitudinally elongated dimension, and is trapezoidal in cross section. The sliding portion 14*a* is slidably fitted in a trapezoidal groove 19 formed in the housing 1. That is, the pintle 14 is held in such a way that it can slide perpendicular to the axis m. This makes it possible to set the distance D between the axis n of the pintle 14 and the axis m to any desired value, including zero.

Figure 1:
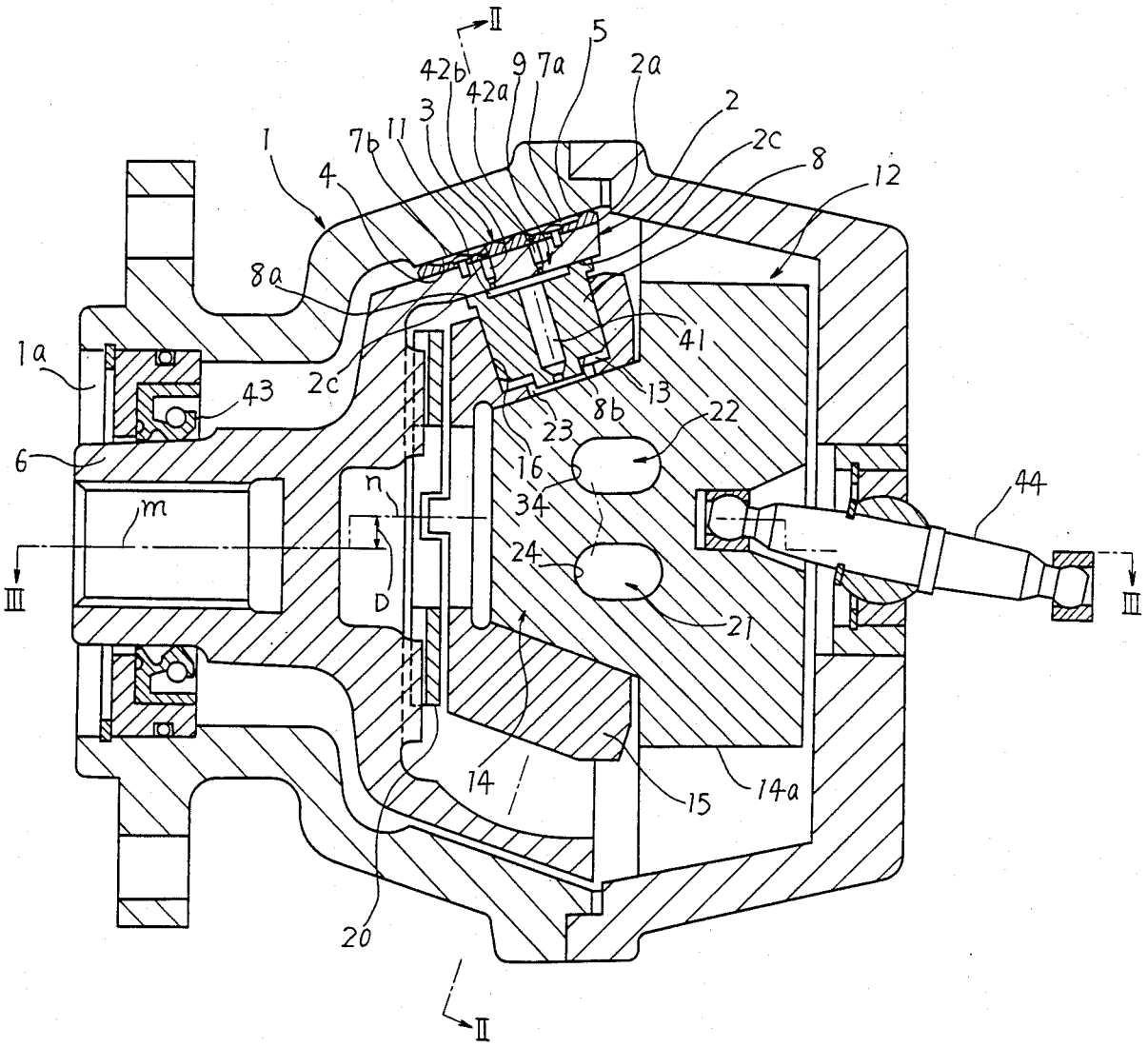
FIG. 1 is a front elevation in cross section of an energy converter according to the instant invention.
Figure 2:
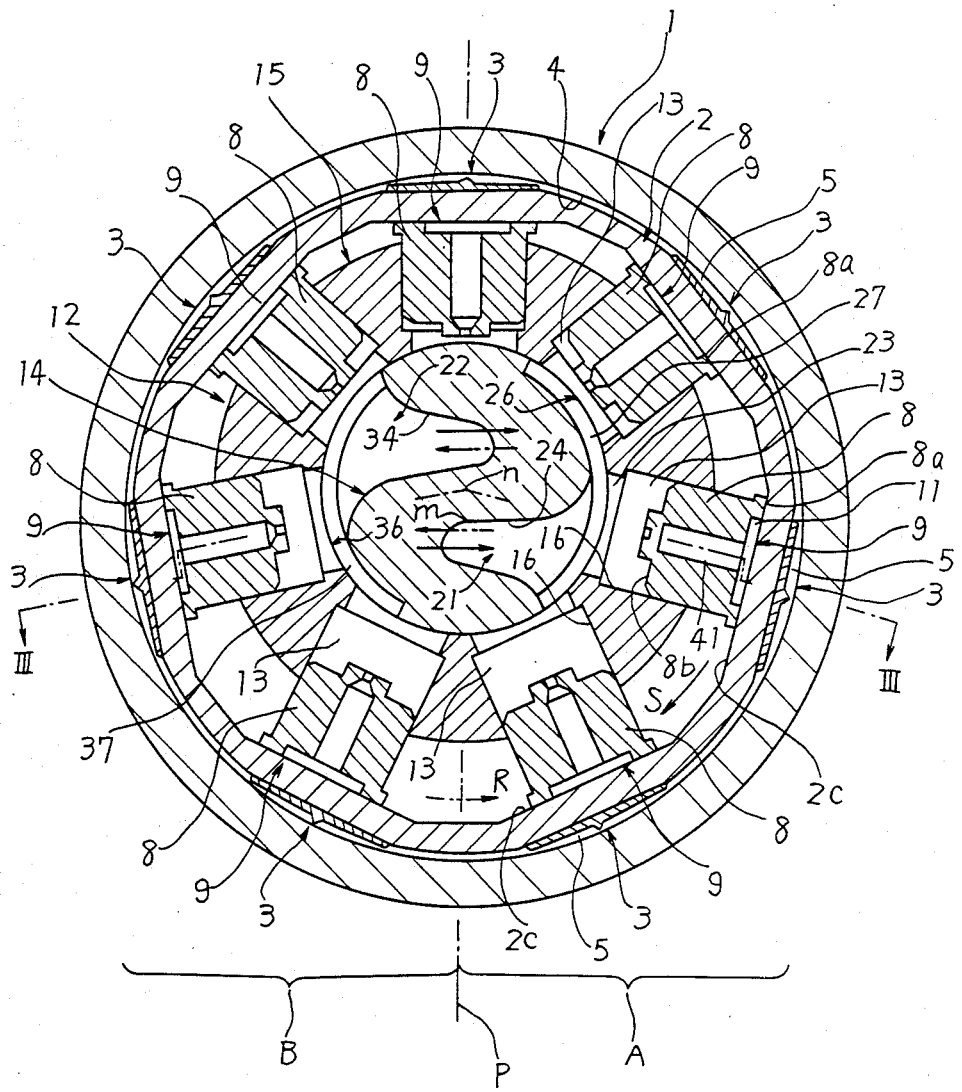
FIG. 2 is a cross-sectional view taken on line II—II of FIG. 1.
Figure 3:
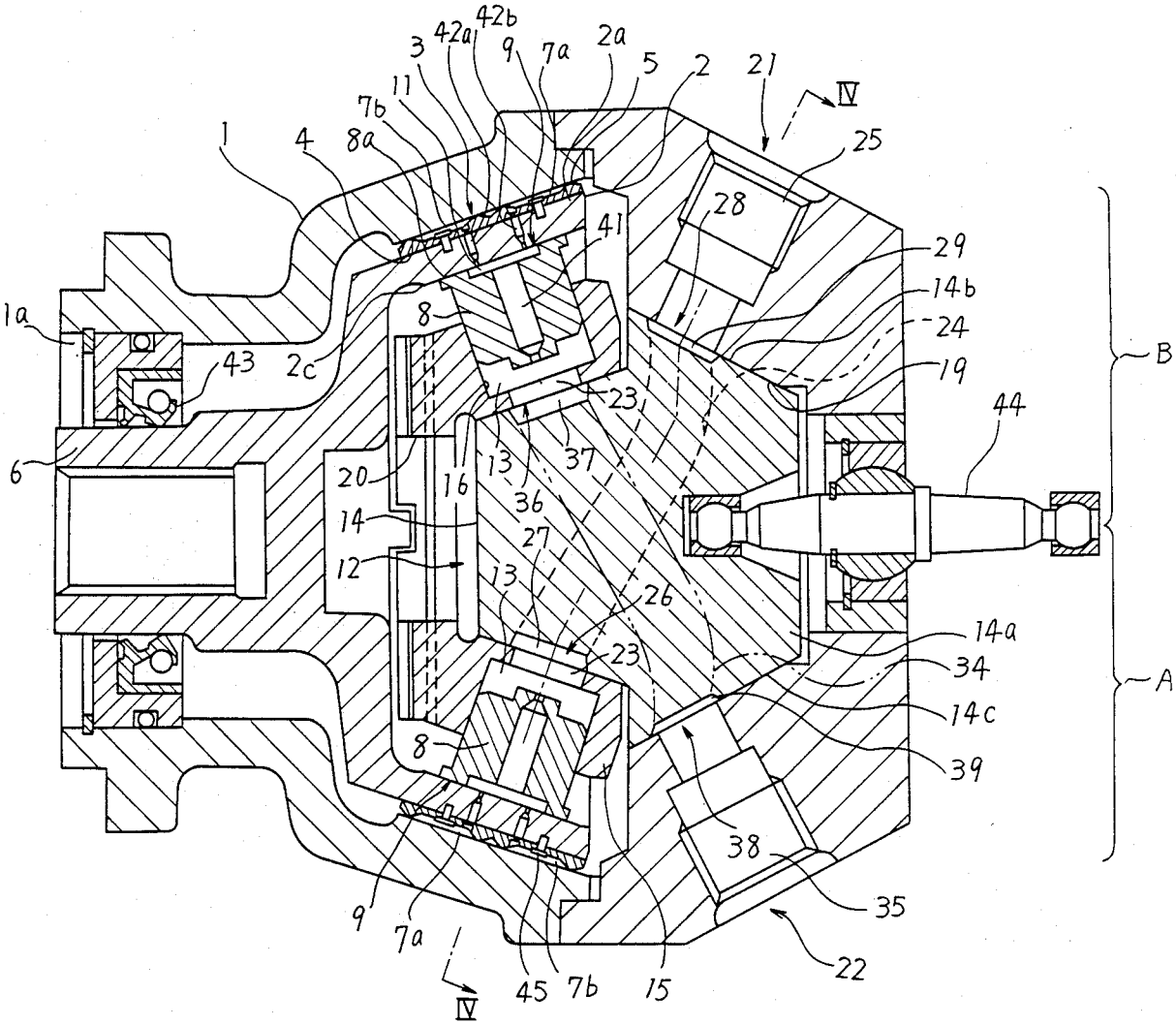
FIG. 3 is a cross-sectional view taken on line III—III of FIG. 1.

As shown in FIG. 2, the inside of the housing 1 is divided into a first region A and a second region B by an imaginary line P that is drawn in the direction in which the pintle 14 slides. Those spaces 13 which are traveling through the first region A are placed in communication with a first fluid communication line 21. Those spaces 13 which are moving across the second region B are made to communicate with a second fluid communication line 22.

The first fluid communication line 21 has fluid passages 23, a port 24 extending through the pintle 14, and a fluid inlet/outlet port 25 formed in the housing 1, corresponding to one end of the port 24. The spaces 13 are in communication with the inside of the barrel 15 via the passages 23. The one end of the port 24 extends to the outer periphery of the pintle 14 on the side of the first region A, while the other end extends to the inclined surface 14*b* of the sliding portion 14*a* of the pintle 14 that is on the side of the second region B. A pressure pocket 27 is formed between the outer periphery of the pintle 14 and the inner surface of the cylinder barrel 15, at one end of the port 24, in order to form a third static pressure bearing 26. Another pressure pocket 29 is formed between the inclined surface 14*b* of the pintle 14 and the inner surface of the housing 1, at the other end of the port 24, to form a fourth static pressure bearing 28. The pocket 27 is elongated circumferentially, and acts to place all the spaces 13 existing in the first region A in communication with the port 24 extending through the pintle. The pocket 29 is elongated in a direction in which the pintle 14 slides. When the pintle 14 is caused to slide, the pocket 29 prevents the port 24 from being disconnected from the fluid inlet/outlet port 25.

The second fluid communication line 22 has the fluid passages 23, a port 34 extending through the pintle, and a fluid inlet/outlet port 35 formed in the housing 1 at a position corresponding to one end of the port 34. The other end of the port 34 extends to the outer surface of the pintle 14 on the side of the second region B, while the other end extends to the inclined surface 14*c* of the sliding portion 14*a* of the pintle 14 on the side of the first region A. At the other end of the port 34, a pressure pocket 37 is formed between the pintle 14 and the cylinder barrel 15 to form another third static pressure bearing 36. At the one end of the port 34, a further pressure pocket 39 is formed between the inclined surface 14*c* of the pintle 14 and the inner surface of the housing 1 to form another fourth static pressure bearing 38. The pockets 37 and 39 are similar in structure to the pockets 27 and 29.

A pressure inlet passage 41 is formed along the axis of each piston 8. The fluid pressure within each space 13 corresponding to each piston 8 is introduced into the pressure pocket 11 in the corresponding second static pressure bearing 9 via the pressure inlet passage 41. The hydraulic pressure within the pocket 11 is introduced into the pressure pockets 7*a*, 7*b* in the corresponding first static pressure bearing 3 via fluid passages 42*a*, 42*b* formed in the ring 2. Restrictors 40*a* and 40*b* are disposed in the passages 42*a* and 42*b*, respectively.

The directions and area of the static pressure bearings 3 and 9 are so set that the force $F_a$ acting on the ring 2 due to the static pressure of the fluid introduced into the first bearings 3 is identical in magnitude but opposite in direction to the force $F_b$ acting on the torque ring due to the static pressure introduced into the second bearings 9. The area of the second bearings 9 is set to such a value that the force acting on the piston 8 due to the static pressure applied to the bearing 9 is cancelled by the force working on the piston 8 due to the static pressure of the fluid within the spaces 13. Further, the area of the third static pressure bearings 26 and 36 is set to such a value that the force acting on the barrel 15 due to the static pressure introduced into the bearings 26 and 36 is cancelled by the force acting on the barrel 15 due to the static pressure of the fluid within the spaces 13 that exist in the corresponding regions A and B. The angle at which the surfaces 14*b* and 14*c* are inclined is set to such a value that the force acting on the pintle 14 due to the static pressure of the fluid introduced to the bearings 28 and 38 is cancelled by the force acting on the pintle 14 due to the static pressure of the fluid introduced to the third bearings 26 and 36 existing in the regions A and B in opposite relation to the inclined surfaces 14*b* and 14*c* on which the bearings 28 and 38 are respectively mounted. Indicated by numeral 43 are seal members. A control lever 44 is used to slide the pintle 14. Each shoe 5 is firmly fixed to the torque ring 2 with a fixing element 45.

The operation of the illustrated converter is now described. When it is used as a hydraulic motor, fluid of high pressure is supplied into the spaces 13 existing in the first region A through the first fluid communication line 21. Then, as shown, the axis n of the pintle 14 is brought to a position that is given distance D apart from the axis m of the housing 1. Thus, as shown in FIG. 4, the line of action of the force $F_a$ acting on the ring 2 due to the static pressure of the fluid introduced in the first bearings 3 rotates in the direction of X relative to the line of force $F_b$ acting on the ring 2 due to the static pressure of the fluid introduced in the corresponding second bearings 9 within the first region A. The forces $F_a$ and $F_b$ are identical in magnitude but opposite in direction to each other. Since they act parallel, they constitute couples. Also as can be seen from FIG. 4, the coupled forces $F_a$ and $F_b$ developed at locations on the ring 2 rotate the ring 2 in the same direction. Therefore, the ring 2 receives the coupled forces $F_a$ and $F_b$ directly from the fluid, so the ring 2 is rotated in the direction indicated by the arrow S.

It is now assumed for the illustrated embodiment that the magnitude of the coupled forces $F_a$ and $F_b$ is equal to F and that the distances of the lines of actions are $l_1$, $l_2$, $l_3$. Then, the moment M acting on the ring 2 is given by $$M=F(l_1+l_2l_3)$$

This moment M causes the ring 2 to rotate relative to the housing 1. In this case, as the ring 2 is rotated, the volume of each space 13 existing in the first region A gradually increases, while the volume of each space 13 existing in the second region B gradually decreases. Accordingly, the fluid of high pressure flows successively into the spaces 13 which are traveling across the first region A, through the first line 21. After doing work, the fluid flows out of the spaces 13 moving across the second region B and is discharged from the housing 1 through the second line 22.

Under this condition, if the pintle 14 slides into its neutral position where the axis n coincides with the axis m of the housing 1, then the distances $l_1$, $l_2$, $l_3$ of the lines of action of the forces $F_a$ and $F_b$ are all reduced to zero. As a result, the moment acting on the ring 2 disappears, making the output zero. If the pintle 14 is moved in the direction opposite to the shown direction across its neutral position distances $l_1$, $l_2$, $l_3$ of the lines of action of the coupled forces $F_a$ and $F_b$ assume negative values, reversing the ring 2.

When the converter is employed as a hydraulic pump, the ring 2 is rotated by an external force, for example, in the direction indicated by the arrow R. Then, coupled forces $F_a$ and $F_b$ are set up on the ring 2 similarly to the foregoing. The input torque applied to the ring 2 is balanced by the coupled forces $F_a$ and $F_b$. Subsequently, fluid outside the housing 1 is forces successively into the spaces 13 traveling across the second region B, through the second fluid communication line 22. The pressurized fluid enters the spaces 13 moving across the first region A, and then it is discharged from the housing 1 through the first line 21. In this case, if the pintle 14 slides to its neutral position, the amount of fluid discharged is zero. This allows the ring 2 to idle under the hydrostatically balanced condition. If the pintle 14 is moved in the direction opposite to the shown direction across the neutral position, then coupled forces $F_a$ and $F_b$ balanced by the input torque are produced in the second region. Then, the fluid of high pressure is delivered out of the housing 1 via the second line 22.

As the ring 2 is rotated relative to the housing 1, the geometrical center b of each first bearing 3 and the center g of each piston 8 are shifted along the Y axis, whether the converter is used as a motor or a pump, as mentioned above. In this fluid energy converter, each first bearing 3 has a pair of pressure pockets 7*a* and 7*b* axially adjacent one another. The fluid flows out of the corresponding spaces 13 and is distributed to the pressure pockets 7*a* and 7*b* via the restrictors 40*a* and 40*b*. Hence, actions shown in FIGS. 8–10 are obtained.

Figure 8:
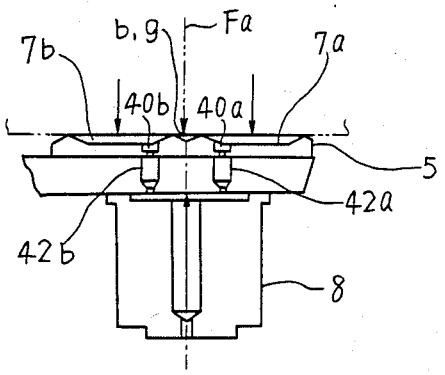
FIGS. 8–10 are fragmentary views for illustrating the operation of the converter shown in FIG. 1.

Referring to FIG. 8, when the geometrical center b of each first bearing 3 is not displaced from the center g of each piston 8 in the direction of the Y axis, the pressure inside the pockets 7*a* and 7*b* are identical, and therefore the point of application q, or center of pressure, of the force $F_a$ acting on the ring 2 due to the static pressure inside the bearings 3 is not displaced at all from the center g of each piston 8 in the direction of the Y axis.

Figure 9:
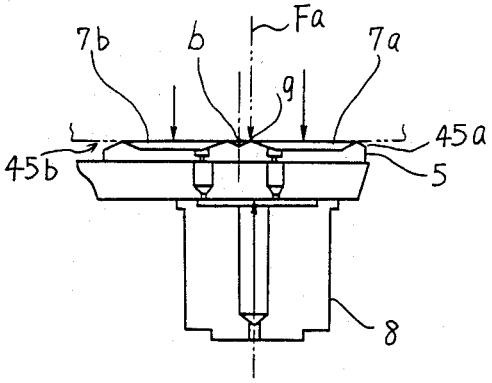

Referring next to FIG. 9, when the center g of each piston 8 is axially displaced from the geometrical center b of each first bearing 3, each fluid leakage gap 45*b* in the bearings 3 that is more remote from the pistons 8 becomes slightly larger than each fluid leakage gap 45*a* closer to the pistons 8 by the flexing of the peripheral wall 2*a* of the ring 2 due to hydraulic pressure. Thus the pressure inside the pocket 7*b* that is more remote from the pistons 8 becomes lower than the pressure inside the pocket 7*a* that is closer to each piston 8. As a result, the center of pressure q of each first bearing 3 comes closer to each piston 8 than the geometrical center b, thus automatically reducing the axial gap between the center pressure q and the center g of each piston 8.

Figure 10:
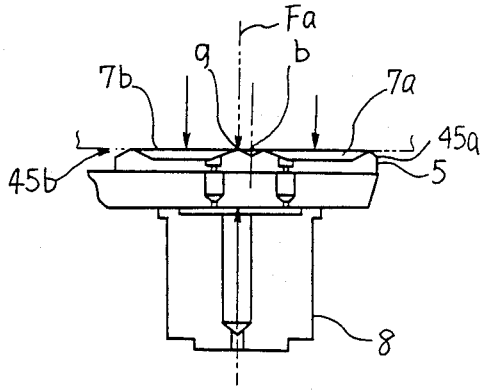
Figure 11:
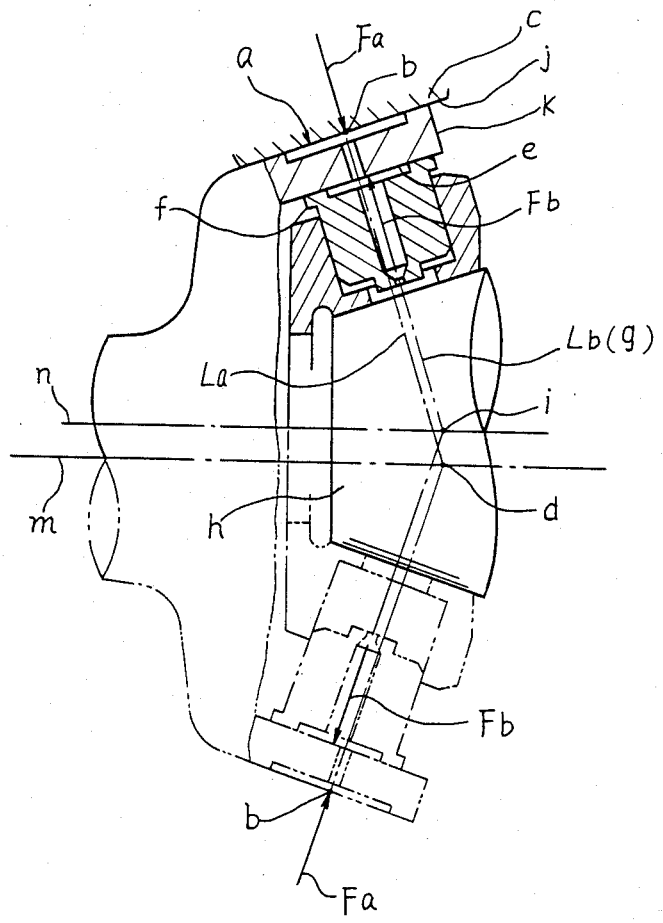
FIG. 11 is a partially cross-sectional view of a conventional converter.
Figure 12:
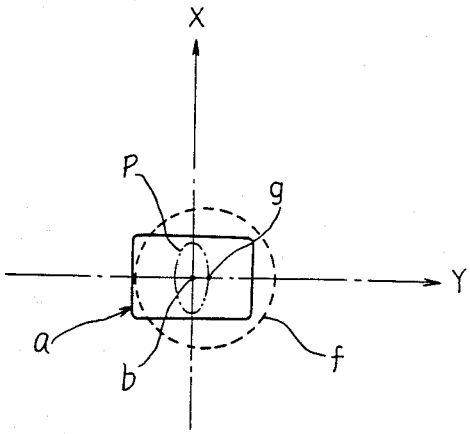
FIG. 12 is a fragmentary plan view of one first static pressure bearing of the converter shown in FIG. 11.
Figure 13:
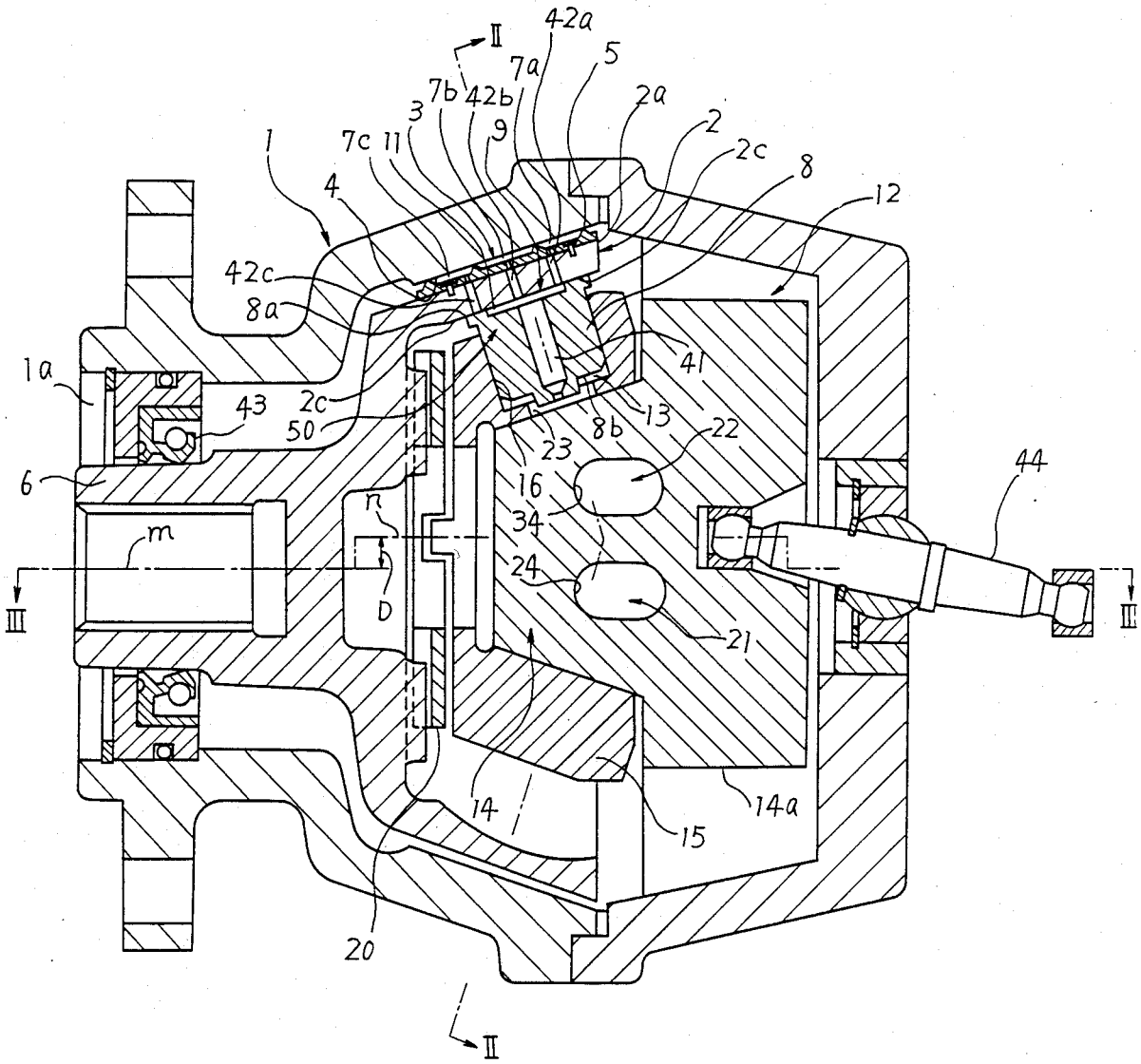
FIG. 13 is a front elevation in cross section of another energy converter according to the instant invention.
Figure 14:
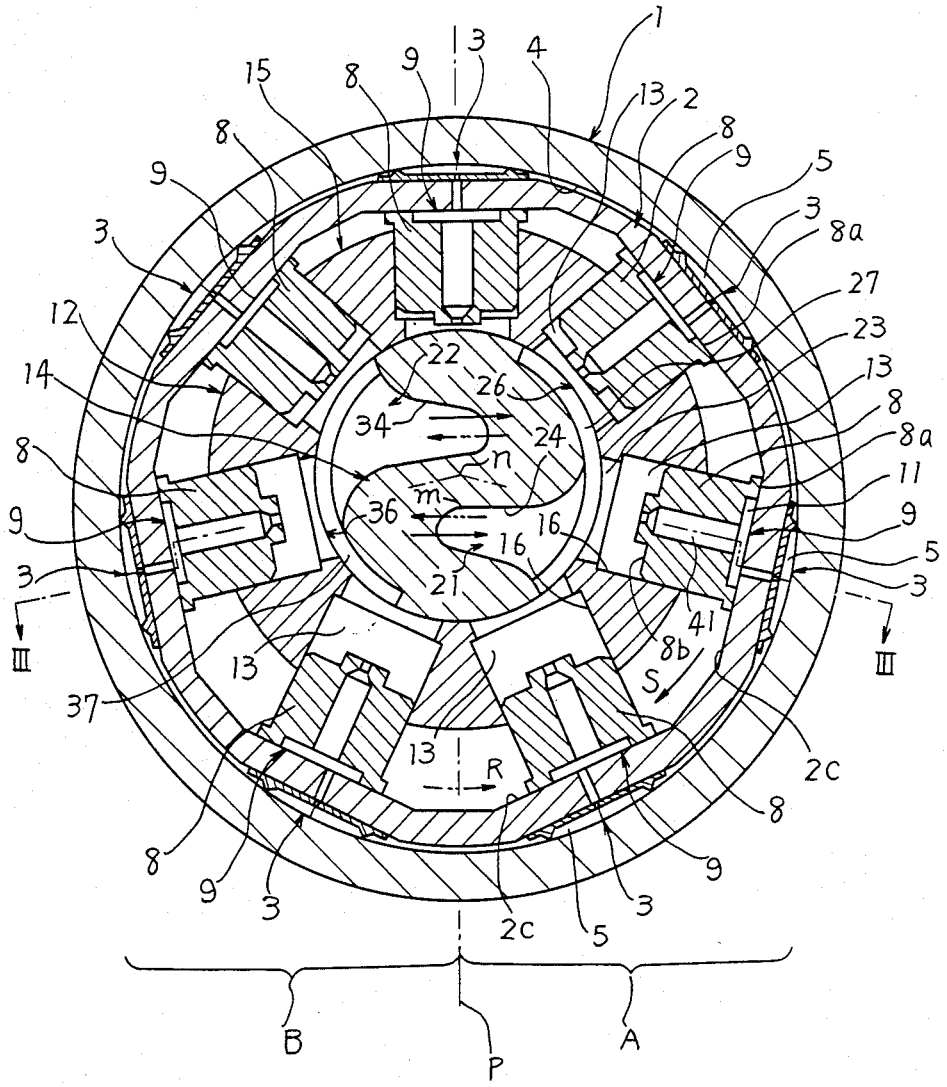
FIG. 14 is a cross-sectional view taken on line II—II of FIG. 13.
Figure 15:
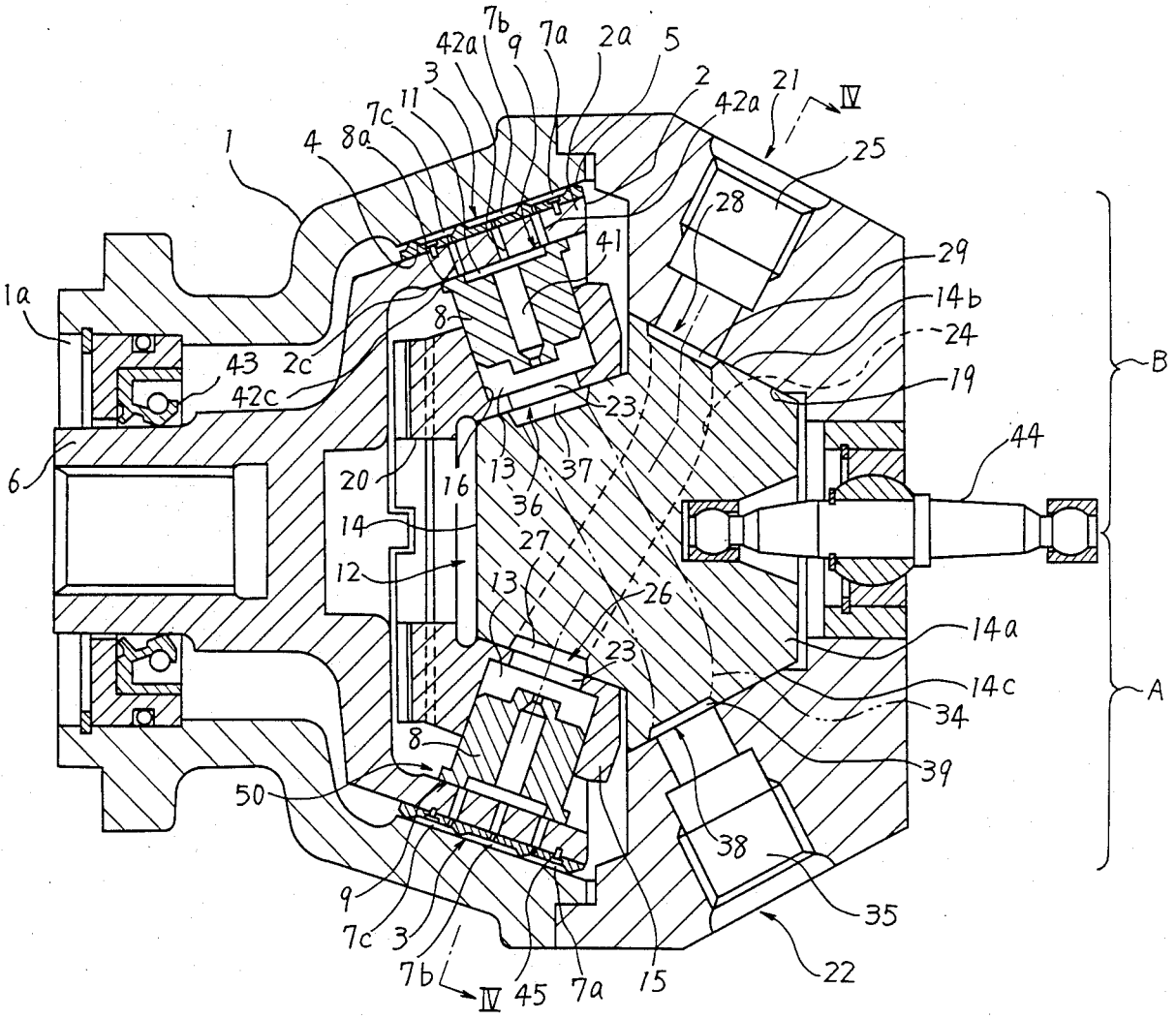
FIG. 15 is a cross-sectional view taken on line III—III of FIG. 13.
Figure 16:
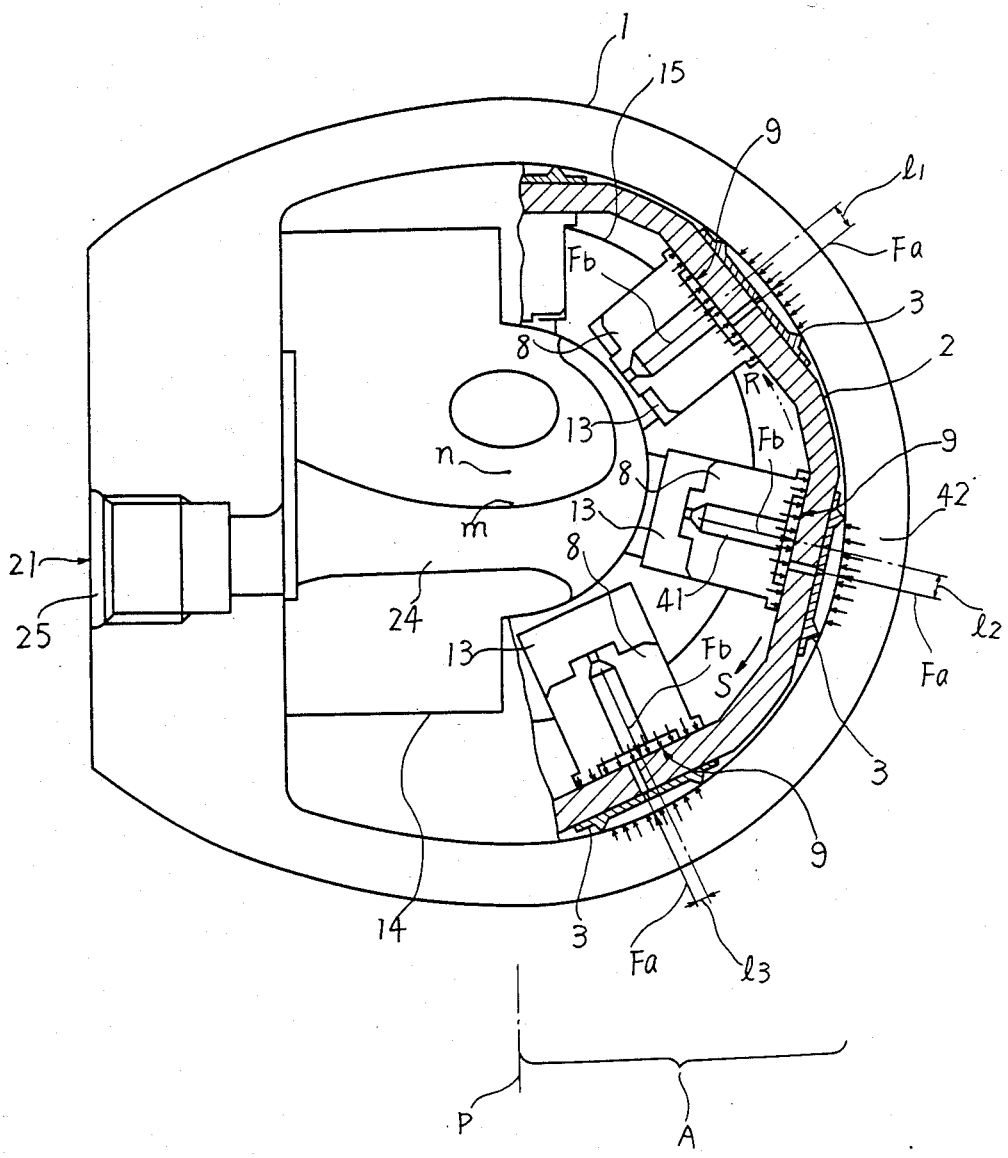
FIG. 16 is a cross-sectional view taken on line IV—IV of FIG. 15.

The condition shown in FIG. 10 is derived by rotating the above condition through 180°. Specifically, when the center g of each piston 8 is displaced from the geometrical center b of each first bearing 3 in the axial direction opposite to the foregoing direction, each fluid leakage gap 45*a* of the bearings 3 that is more remote from each piston 8 becomes slightly larger than each fluid leakage gap 45*b* that is closer to each piston by the flexing of the peripheral wall 2*a* of the ring 2 that is caused by the hydraulic pressure. Thus, the pressure inside the pocket 7*a* more remote from each piston 8 becomes lower than the pressure inside the pocket 7*b* closer to each piston. As a result, the center of pressure q of each first bearing 3 comes closer to each piston 8 than the geometrical center b. Also, the axial gap between the center of pressure q and the center g of each piston 8 is automatically reduced.

The novel rotary fluid energy converter can be employed either as a hydraulic pump or as a hydraulic motor as mentioned above. In either case, only the hydrostatic pressure of the fluid introduced into the first bearings 3 and the second bearings 9 produces the coupled forces $F_a$ and $F_b$ are balanced by the input or output torque acting on the ring 2. Hence, hydrostatic pressure of the fluid can be directly converted into only rotary motion of the ring 2. Also it is possible to transform the rotary motion of the ring 2 into pressurized fluid. Thus, a mechanism for mechanically converting rectilinear motion and rotary motion is entirely dispensed with. Further, as described already, the axial gap between the center of pressure of each first bearing and the center of each piston is minimized to thereby prevent undue bending or twisting force from acting on the ring.

Figure 17:
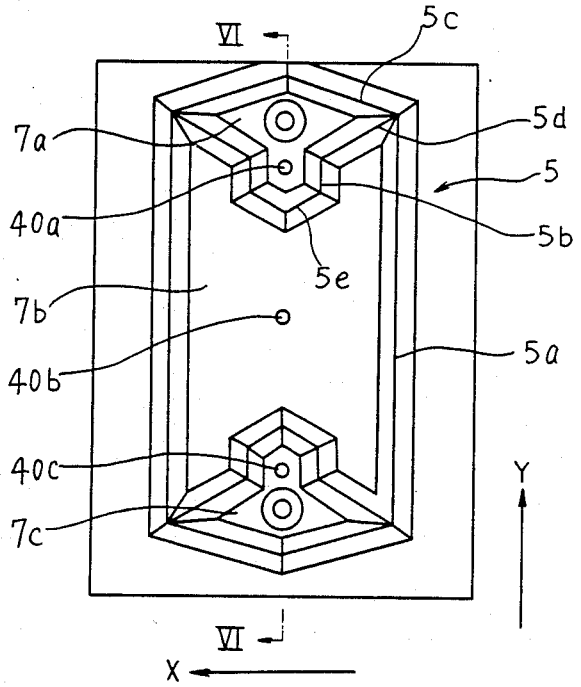
FIG. 17 is an enlarged plan view of the pressure pocket of one static pressure bearing of the converter shown in FIG. 13.
Figure 18:
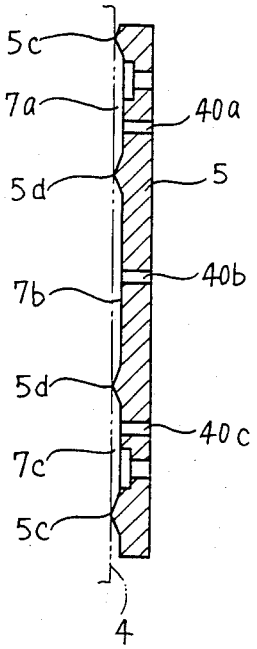
FIG. 18 is a cross-sectional view taken on line VI—VI of FIG. 17.
Figure 19:
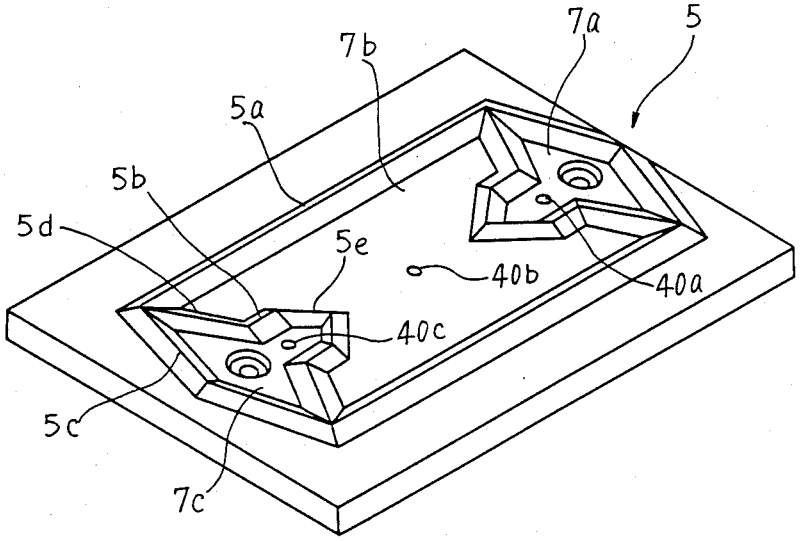
FIG. 19 is a perspective view of pressure pockets shown in FIG. 13.

Referring next to FIGS. 13–22, there is shown another energy converter according to the invention. This converter is similar to the converter already described in connection with FIGS. 1–10, except for the structure of shoes of the static pressure bearings. This converter has first static pressure bearings 3 which attach shoes 5 to the outer periphery of the torque ring 2 at requisite positions, the shoes 5 being also attached to the tapering surface 4 of the housing 1. Each shoe 5 is provided with three pressure pockets 7*a*, 7*b*, 7*c* axially adjacent one another. Hydraulic pressure is introduced into these pockets 7*a*–7*c*. An odd number of bearings 3 are circumferentially and regularly spaced from one another. The surrounding portions 5*a*, 5*b*, 5*c*, 5*d*, 5*e* that surround the pressure pockets 7*a*–7*c* are so shaped that their cross section protrudes toward the tapering surface 4, as shown in FIGS. 17–19. This reduces the area with which each shoe 5 makes sliding contact with the tapering surface 4. Also, the surrounding portions 5*a*–5*e* are formed so as not to be parallel to the direction of rotation X. More specifically, only the surrounding portions 5*a* and 5*b* which are perpendicular to the direction of rotation X are shaped into a rectilinear form. The surrounding portions 5*c* and 5*e* are shaped like the letter "V". The surrounding portion 5*d* is so shaped as to be oblique to the direction of rotation X. It is to be noted that FIGS. 13–16 are basically the same as FIGS. 1–4, and the components shown in those figures will not be described herein.

In this structure, the hydraulic pressure inside the spaces 13 corresponding to the pistons 8 is directed into the pressure pockets 11 in the corresponding second bearings 9 via the pressure inlet passage 41 formed along the axis of each piston 8. The hydraulic pressure inside the pockets 11 is routed into the pressure pockets 7*a*, 7*b*, 7*c* in the corresponding bearings 3 via the fluid passages 42*a*, 42*b*, 42*c* formed in the ring 2. These passages 42*a*–42*c* cooperate with the pressure pockets 11 to form slide valve elements 50.

Figure 20:
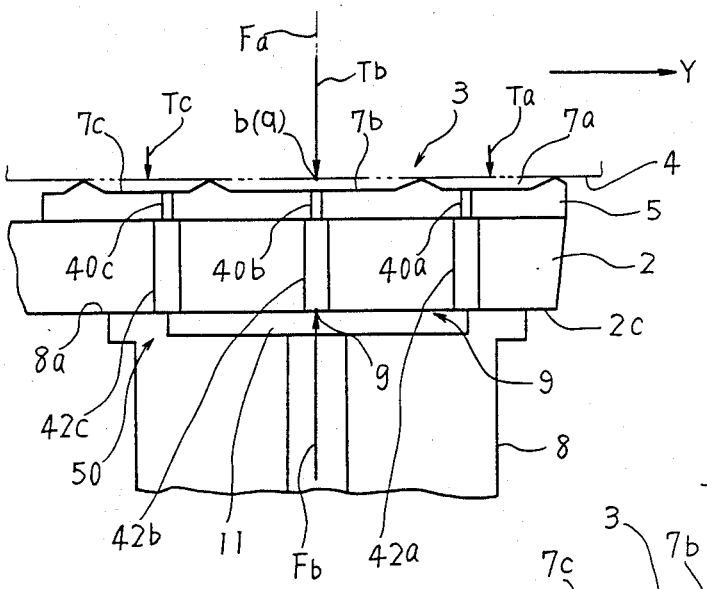
FIGS. 20–22 are fragmentary views for illustrating the operation of the converter shown in FIG. 13.
Figure 21:
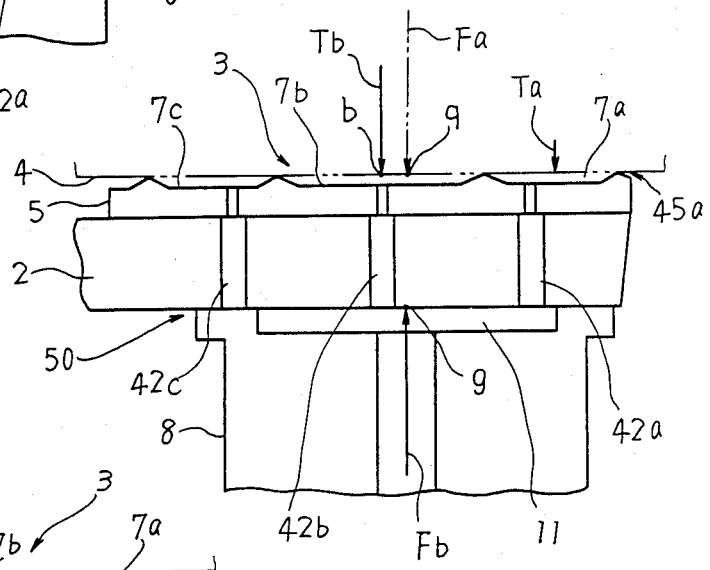
Figure 22:
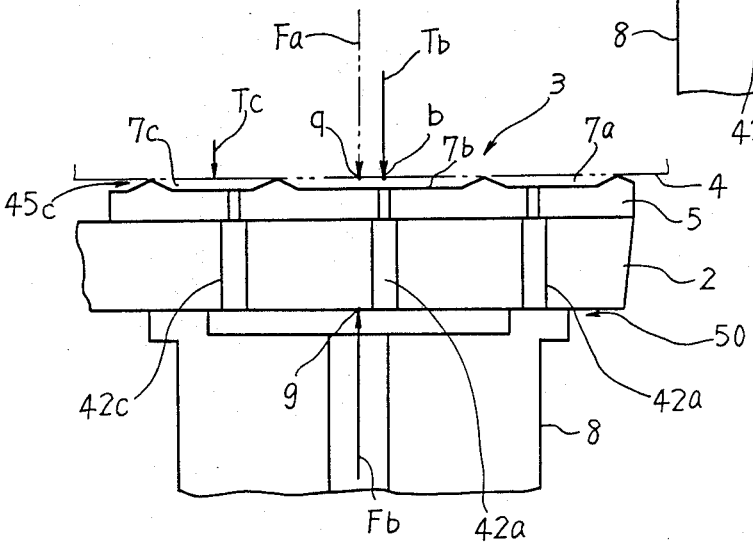
Figure 23:
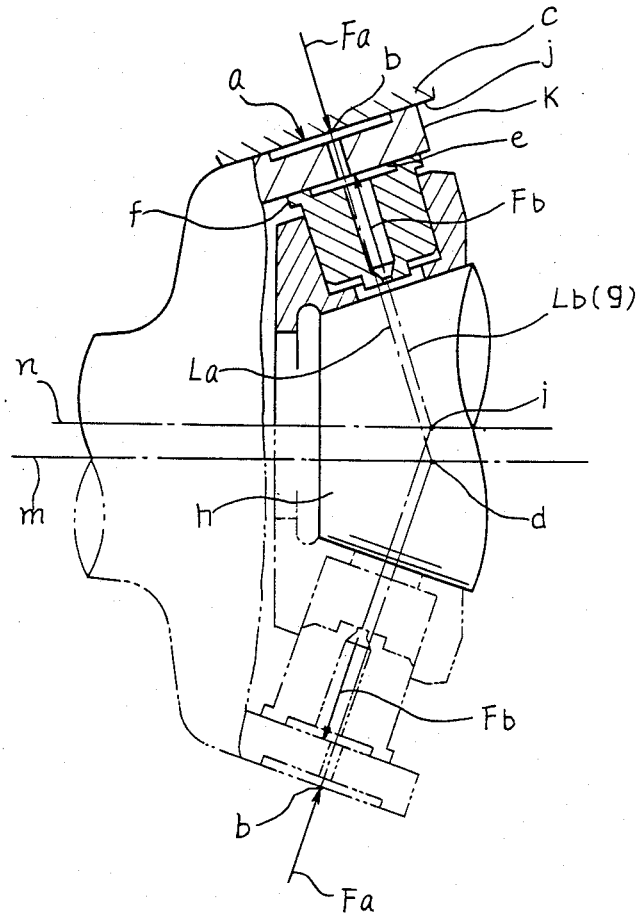
FIG. 23 is a partially cross-sectional view of a conventional converter.

Referring to FIGS. 20–22, each valve element 50 acts to selectively cut off the supply of fluid into the pockets 7*a*, 7*b*, 7*c*, making use of the relative movement between each piston 8 and the ring 2 in the direction of the Y axis. When the distance between the geometrical center b of each first bearing 3 and the center g of each piston 8 in the direction of the Y axis lies within a certain range, the pockets 11 are in communication with all the fluid passages 42a, 42b, 42c. When the distance increases beyond the range, the passage 42c or 42a most remote from the piston 8 breaks communication with the pocket 11, as shown in FIGS. 21 and 22. The restrictors 40a, 40b, 40c are installed in the passages 42a and 42b.

Figure 24:
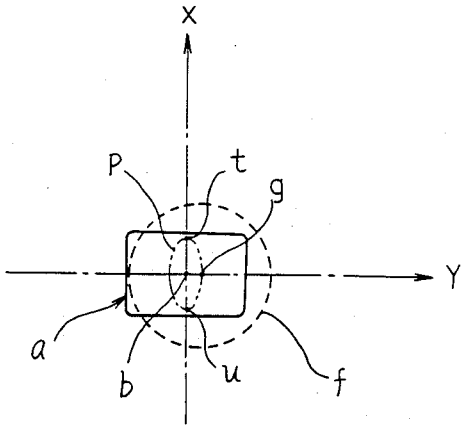
FIG. 24 is a fragmentary plan view of one first static pressure bearing shown in FIG. 23.

As described above, as the ring 2 is rotated relative to the housing 1, the geometrical center b of each first bearing 3 and the center g of each piston 8 are moved in the direction of the Y axis, whether the converter is used as a motor or pump. In this fluid energy converter, each first bearing 3 is provided with the pressure pockets 7a, 7b, 7c axially adjacent one another. Each slide valve element 50 is provided to selectively interrupt the supply of the fluid into the pockets 7a–7c, making use of the relative movement between each piston 8 and the ring 2 in the direction of the Y axis. Consequently, actions as shown in FIGS. 20–22 are obtained. Specifically, when the geometrical center b of each first bearing 3 is not displaced from the center g of each piston 8 in the direction of the Y axis as shown in FIG. 20, all the fluid communication passages 42a, 42b, 42c are in communication with the pressure pockets 11, so that the pressures inside the pockets 7a, 7b, 7c are equal. Consequently, the point of applications q, or center of pressure, of the force $F_a$ acting on the ring 2 due to the static pressure in the first bearings 3 is not displaced at all from the center g of each piston 8 in the direction of the Y axis. When the center g of the piston 8 is displaced only slightly in the direction of the Y axis but displaced considerably to the vicinities of points t and u shown in FIG. 24 in the direction of the X axis, the fluid passages 42a and 42c are disconnected from the pockets 11, leaving only the fluid passages 42b in communication with the pockets 11. The result is that the center g of each piston 8 is axially displaced only slightly from the point of application q, or the center of pressure, of the force $F_a$ acting on the ring 2.

When the center g of each piston 8 is displaced from the geometrical center b of each first bearing 3 in the direction of the Y axis as shown in FIG. 21, the passage 42c most remote from the piston 8 is not in communication with the pocket 11. This permits pressurized fluid to be supplied only in two pressure pockets 7a and 7b in the bearing 3 which are closer to the piston 8. As a result, the center of pressure q of the first bearing 3 comes closer to the piston 8 than the geometrical center b. In this way, the axial gap between the center of pressure q and the center g of each piston 8 is automatically reduced. When this condition is rotated through 180°, the condition shown in FIG. 22 is derived.

Referring to FIG. 22, when the center g of each piston 8 is axially displaced from the geometrical center b of each first bearing 3 in the direction opposite to the foregoing direction, the passage 42a most remote from the piston 8 is disconnected from the pocket 11. Hence, pressurized fluid is supplied only into the two pressure pockets 7b and 7c in the bearing 3 which are closest to the piston 8. As a result, the center of pressure q of each first bearing 3 comes closer to each piston 8 than the geometrical center b. Also in this case, the gap between the center of pressure q and the center g of the piston is automatically reduced. Immediately after the fluid passage 42c or 42a is isolated, i.e., when the geometrical center b of the bearing 3 is not yet displaced from the center g of the piston 8 greatly, there arises the possibility that the center of pressure q becomes more remote from the geometrical center b than the center g of the piston 8. If the pressure center q moves past the center g of the piston 8 across the geometrical center in the direction of the Y axis, the flexing of the peripheral wall 2a of the ring 2 makes slightly larger the fluid leakage gap 45c or 45a to which the pressure center q has come closer. Then, the pressure inside the pressure pocket 7a or 7b to which the pressure center has come closer decreases slightly. Therefore, the position of the pressure center is brought closer to the center g of the piston 8. In FIGS. 20–22, $F_a$, $F_b$, and $F_c$ schematically indicate forces acting on the ring 2 because of the pressures inside the pockets 7a, 7b, 7c, respectively.

Since the converter is designed as described above, the distance between the pressure center of each first static pressure bearing and the center of each piston along the Y axis is reduced to a minimum in the same manner as in the converter already described in conjunction with FIGS. 1–10. This can prevent undue bending or twisting force from acting on the torque ring. Therefore, it is easy to design the structure in such a way that its components are not severly pressed against each other or twisting force does not act on them. Further, it is possible to fully dispense with bearings utilizing the wedging action of oil film that relies on oiliness or viscosity of lubricating oil, or with bearings utilizing rolling action of balls, rolls, or the like. Thus, it is possible to fabricate all sliding portions of components from static pressure bearings, in which case water or other fluid exhibiting a viscosity approximate to that of water can be employed without introducing any difficulty. Also, when static pressure bearings are used instead of roller bearings, the machine is not affected by the life of roller bearings. This makes it possible to increase the life of the machine. In addition, it helps make the machine smaller and more lightweight.

When the eccentric position of the pintle relative to the axis of the housing is adjusted as in the illustrated embodiment, the converter can be advantageously used as a hydraulic pump or motor of a variable displacement type. Of course, the invention is not limited to this scheme. Also, where the eccentric position of the pintle is adjustable, the adjusting means is not limited to the foregoing means, but rather various changes and modifications may be made. For instance, the pintle may be reciprocated by a hydraulic actuator.

Figure 25:
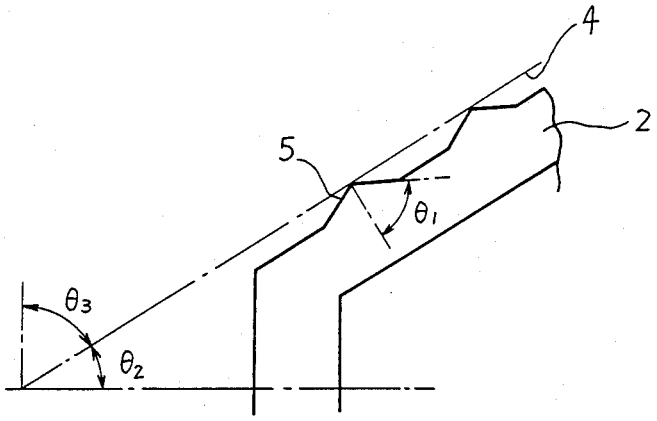
FIG. 25 is a diagram for showing a further energy converter according to the instant invention.

Furthermore, the cross-sectional shape of the surrounding portions that surround the pressure pockets in the first static pressure bearings is not limited to the shape described above. Where the cross section protrudes as described already, however, spaces of wedge-shaped cross section are formed between the surrounding portions and the tapering surface. When the converter operates, fluid enters the wedge-shaped spaces, producing hydrodynamic pressure. This allows the housing and the torque ring to be rotated relative to each other more smoothly. Where the surrounding portions are so shaped that any portion of them is not parallel to the direction of rotation, the hydrodynamic pressure is generated on every portion of the surrounding portions. Therefore, when the converter runs at high speeds, an especially excellent bearing action can be obtained. Obviously, it is possible to fabricate the torque ring 2 and the shoes 5 integrally as shown in FIG. 25. When the ring 2 and the shoes 5 are integrally molded, angle $\theta_1$ which is half of the angle that the protruding portion of each surrounding portion makes is made larger than the complementary angle $\theta_3$ of the taper angle $\theta_2$ at the tapering portion of the outer periphery of the torque ring. Then, molds for the outer periphery of the ring can be removed axially, enhancing the productivity. In other words, by making the gradient of the protruding portion of the cross section of the surrounding portion not larger than the gradient of the cone formed by the inner surface of the housing, the draw of molds is facilitated. Additionally, the number of pistons is not limited to the number in the illustrated embodiment. Still further, working fluid is not limited to liquids. For example, it can be a gas such as air.

Since the novel rotary fluid energy converter is constructed as described thus far, it can act either as a pump or as a motor without using a mechanism for mechanically converting rectilinear or rotary motion into another form of motion. Further, it includes a simple structure which does not use a valve element or the like, but which can effectively prevent coupled forces from occurring on the torque ring about a point other than the axis of rotation, which would otherwise be caused by the presence of axial distance between the pressure center of each first static pressure bearing and the center of each piston.

I claim:

1. A rotary fluid energy converter comprising:

a housing having a tapering surface in its inner surface;

a torque ring closely held against the tapering surface of the housing via first static pressure bearings that are circumferentially spaced from one another, the ring having flat inner surfaces corresponding to the first bearings;

pistons disposed on the inner side of the torque ring and having their front ends attached to the flat inner surfaces of the ring via second static pressure bearings;

a cylinder barrel for slidably holding the base ends of the pistons;

a pintle which is disposed in an eccentric relation to the axis of the housing and which rotatably holds the cylinder barrel;

spaces formed between each piston and the cylinder barrel, the volumes of the spaces being increased or decreased as the torque ring is rotated relative to the housing;

two fluid communication lines which communicate with the spaces whose volumes are increasing and decreasing, respectively;

fluid passages for directing fluid from the spaces to the first and second static pressure bearings, whereby the static pressure of the fluid introduced in the first static pressure bearings and the static pressure of the fluid introduced in the second static pressure bearings produced coupled forces about the axis of rotation of the torque ring;

at least one pair of axially adjacent pressure pockets formed in each of the first static pressure bearings; and restrictors through which fluid flowing out of the spaces is distributed to the corresponding pressure pockets, and wherein the pressurization of the pressure pockets of said first static pressure bearings is effected by sliding surfaces between the flat inner surfaces of the torque ring and the flat surfaces of the pistons.

2. A rotary fluid energy converter comprising:

a housing having a tapering surface in its inner surface;

a torque ring closely held against the tapering surface of the housing via first static pressure bearings that are circumferentially spaced from one another, the ring having flat inner surfaces corresponding to the first bearings;

pistons disposed on the inner side of the torque ring and having their front ends attached to the flat inner surfaces of the ring via second static pressure bearings;

a cylinder block for slidably holding the base ends of the pistons;

a pintle which is disposed in an eccentric relation to the axis of the housing and which rotatably holds the cylinder block;

spaces formed between each piston and the cylinder block, the volumes of the spaces being increased or decreased as the torque ring is rotated relative to the housing;

two fluid communication lines which communicate with the spaces whose volumes are increasing and decreasing, respectively;

fluid passages for directing fluid from the spaces to the first and second static pressure bearings, whereby the static pressure of the fluid introduced in the first static pressure bearings and the static pressure of the fluid introduced in the second static pressure bearings produce coupled forces about the axis of rotation of the torque ring;

at least one pair of axially adjacent pressure pockets formed in each of the first static pressure bearings; and slide valve elements for selectivity interrupting the supply of fluid into the pressure pockets by making use of axial, relative movement between each piston and the torque ring to minimize the axial gap between the pressure center of each first static pressure bearing and the center of each piston, and wherein the pressurization of the pressure pockets of said first static pressure bearings is effected by sliding surfaces between the flat inner surfaces of the torque ring and the flat surfaces of the pistons.

* * * * *